US007631816B2

(12) United States Patent
Jabado et al.

(10) Patent No.: US 7,631,816 B2
(45) Date of Patent: Dec. 15, 2009

(54) COLD SPRAYING INSTALLATION AND COLD SPRAYING PROCESS WITH MODULATED GAS STREAM

(75) Inventors: Rene Jabado, Berlin (DE); Jens Dahl Jensen, Berlin (DE); Ursus Krüger, Berlin (DE); Daniel Körtvelyessy, Berlin (DE); Volkmar Lüthen, Berlin (DE); Ralph Reiche, Berlin (DE); Michael Rindler, Schöneiche (DE); Raymond Ullrich, Schönwalde (DE)

(73) Assignee: Siemens Aktiengesellschaft, Munich (DE)

( * ) Notice: Subject to any disclaimer, the term of this patent is extended or adjusted under 35 U.S.C. 154(b) by 431 days.

(21) Appl. No.: 11/651,730

(22) Filed: Jan. 10, 2007

(65) Prior Publication Data

US 2007/0187525 A1 Aug. 16, 2007

(30) Foreign Application Priority Data

Jan. 10, 2006 (EP) ..... 06000403

(51) Int. Cl.

| | |
|---|---|
| ***B05B 1/24*** | (2006.01) |
| ***B05B 7/00*** | (2006.01) |
| ***B05C 5/04*** | (2006.01) |
| ***B05C 19/00*** | (2006.01) |

(52) U.S. Cl. ..... 239/79; 239/80; 239/135; 118/308

(58) Field of Classification Search ..... 239/8, 239/11, 13, 79, 80, 128, 135, 302–304, 398, 239/407, 408, 533.1, 533.13; 118/300, 308, 118/310; 427/180, 189–191, 201, 421.1, 427/446, 451, 453, 455, 456

See application file for complete search history.

(56) References Cited

U.S. PATENT DOCUMENTS

| | | | | |
|---|---|---|---|---|
| 4,142,089 | A | 2/1979 | Lau et al. | |
| 5,302,414 | A | 4/1994 | Alkhimov et al. | |
| 6,024,792 | A | 2/2000 | Kurz et al. | |
| 6,124,563 | A | 9/2000 | Witherspoon et al. | |
| 6,502,767 | B2 | 1/2003 | Kay et al. | |
| 6,630,207 | B1 | 10/2003 | Eidelman | |
| 2004/0037954 | A1 | 2/2004 | Heinrich et al. | |
| 2007/0098912 | A1 * | 5/2007 | Raybould et al. | 427/446 |

FOREIGN PATENT DOCUMENTS

| | | | |
|---|---|---|---|
| DE | 103 19 481 | A1 | 11/2004 |
| EP | 0 412 397 | A1 | 2/1991 |
| EP | 0 486 489 | B1 | 5/1992 |
| EP | 0 786 017 | B1 | 7/1997 |
| EP | 0 892 090 | A1 | 1/1999 |
| EP | 0 924 315 | B1 | 6/1999 |
| EP | 1 132 497 | A1 | 9/2001 |
| EP | 1 204 776 | B1 | 5/2002 |
| EP | 1 306 454 | A1 | 5/2003 |
| EP | 1 319 729 | A1 | 6/2003 |
| WO | WO 99/67435 | A1 | 12/1999 |
| WO | WO 00/44949 | A1 | 8/2000 |
| WO | WO 03/041868 | A2 | 5/2003 |
| WO | WO 2005/061116 | A1 | 7/2005 |

* cited by examiner

*Primary Examiner*—Darren W Gorman

(57) ABSTRACT

The cold spraying process according to the invention uses cold gas streams whose properties (temperature (T), particle density (ρ), pressure (p), particle velocity (v)) are variably changed such that they can be adapted to the desired properties of the coatings.

5 Claims, 6 Drawing Sheets

COLD SPRAYING INSTALLATION AND COLD SPRAYING PROCESS WITH MODULATED GAS STREAM

CROSS REFERENCE TO RELATED APPLICATIONS

This application claims the benefits of European Patent application No. 06000403.3 filed Jan. 10, 2006. All of the applications are incorporated by reference herein in their entirety.

FIELD OF INVENTION

The invention relates to a cold spraying installation and a cold spraying process.

BACKGROUND OF THE INVENTION

The prior art has already disclosed various processes for producing layers which are applied to components and used at high temperatures. These include vapor deposition processes, such as for example PVD or CVD, or thermal spraying processes (plasma spraying, HVOF: EP 0 924 315 B1).

Another coating process is the cold spraying process or cold gas dynamic spraying process, which is known from U.S. Pat. No. 5,302,414, US 2004/0037954 A1, EP 1 132 497 A1 and U.S. Pat. No. 6,502,767.

Cold spraying uses pulverulent materials with grain sizes of greater than 5 μm, ideally between 20 and 40 μm. For reasons of kinetic energy, it has not hitherto been possible to spray nanoparticle materials in order to achieve nanostructured coatings.

U.S. Pat. No. 6,124,563 and U.S. Pat. No. 6,630,207 describe pulsed thermal spraying processes. DE 103 19 481 A1 and WO 2003/041868 A2 describe special spray nozzle designs for the cold spraying process.

SUMMARY OF INVENTION

Therefore, it is an object of the invention to improve the cold spraying process, in particular such that nanocrystalline powders can also be used.

The object is achieved by the cold spraying installation as claimed in the claims and the cold spraying process as claimed in the claims.

The measures listed in the subclaims can be combined with one another in any advantageous way.

BRIEF DESCRIPTION OF THE DRAWINGS

The invention is explained in more detail and by way of example with reference to the figures, in which.

DETAILED DESCRIPTION OF INVENTION

Figure 1:
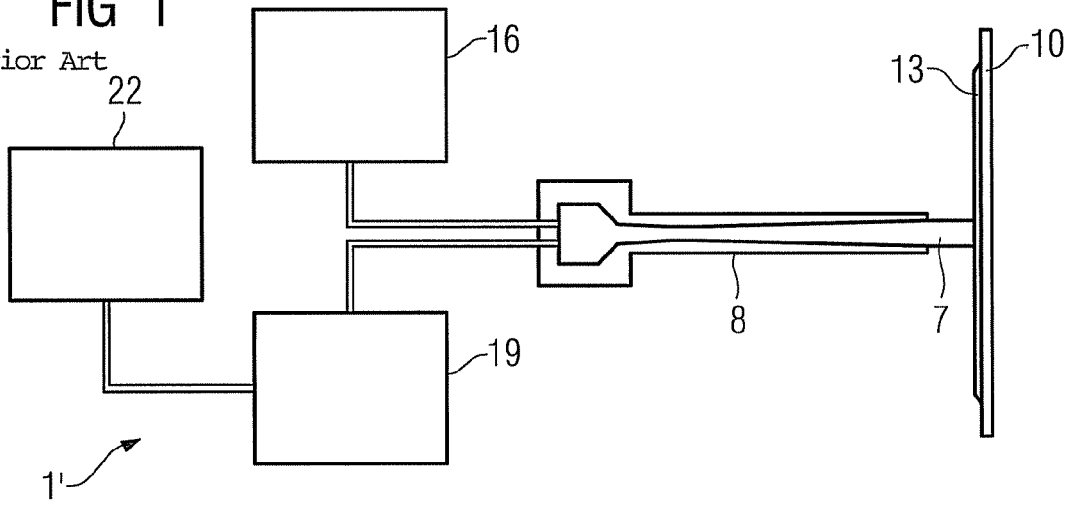
FIG 1 Prior Art
FIG. 1 shows a cold spraying installation of the prior art.

FIG. 1 shows a prior art cold spraying installation 1'. The powder for a coating 13 is fed through a nozzle 8 onto a substrate 10, for example a component (turbine blade or vane 120, 130 (FIGS. 9, 10), combustion chamber wall 155 (FIG. 11) or a housing part (FIG. 9) of a turbine 100 (FIG. 9)), so that a coating 13 is formed there. The powder comes from a powder container 16, the pressure which is required for the cold spraying being generated by a high-pressure gas generator 22, so as to generate a cold gas particle stream 7 by the powder being fed to the high-pressure gas as carrier gas in the nozzle 8. The high-pressure gas can if appropriate be heated by means of a heater 19. The heater 19 may be integrated in the high-pressure gas generator.

Cold spraying means using temperatures of up to at most 80° C.-550° C., in particular 400° C. to 550° C. The substrate temperature is 80° C. to 100° C. The velocities are 300 m/s to 2000 n/s.

Figure 2:
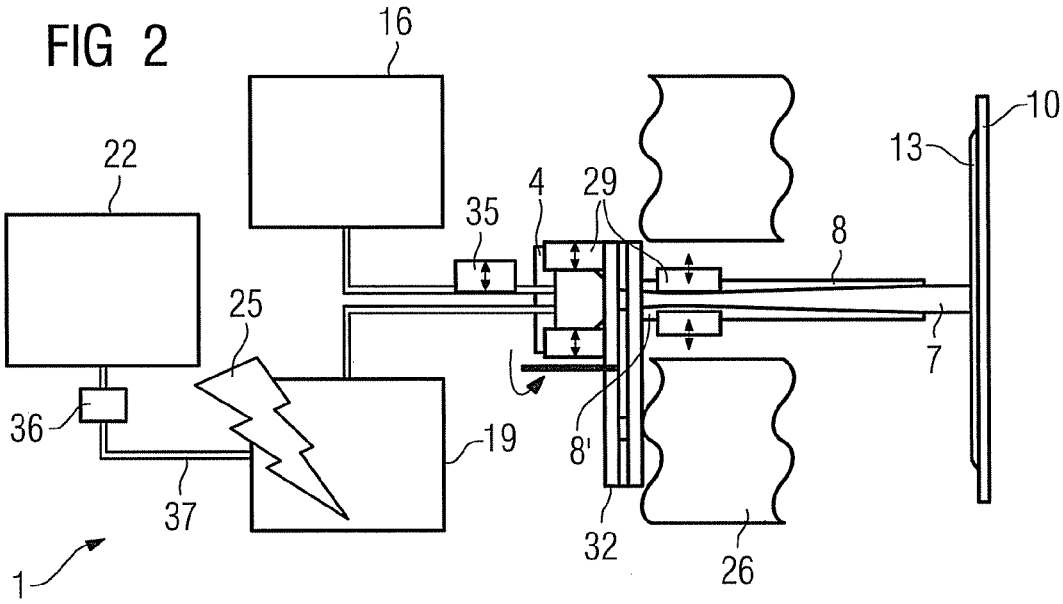
FIGS. 2-8 show a cold spraying installation configured in accordance with the invention.

FIG. 2 shows a cold spraying installation 1 according to the invention. The cold spraying installation 1 of the invention, unlike the prior art (FIG. 1), has one or more influencing means 25, 26, 29, 32, 35, 36 which variably change (modulate) at least one property of the cold gas particle stream 7 (e.g. temperature T, pressure p, particle density ρ, particle material M, velocity v, etc.).

This influencing of the properties of the cold gas particle stream 7 may take place periodically or aperiodically during a coating operation. It is also possible during a coating operation for coating times with period changes to be followed by aperiodic changes, or vice versa. Only a periodic change in one or more of the properties is preferred.

The influencing means may, for example, be a pulsed heating means 25 which heats the high-pressure gas of the high-pressure gas generator variably, preferably in pulsed fashion, thereby leading to modulation of the cold gas particle stream 7. The pulsed heating means 25 may also be part of the heater 19.

It is also possible for a valve 32 as influencing means, in particular a perforated disk (chopper) 32, to be arranged upstream of the nozzle inlet opening 8'. Since this interrupts the cold gas particle stream 7 periodically or aperiodically, a pulsed cold gas particle stream 7 is generated in the direction of the substrate 10, producing locally different particle densities ρ in the direction of the jet. When the valve 32 is closed, material builds up upstream of the nozzle 8, generating a higher pressure, which is relieved again after the valve has been opened.

A modulated cold gas particle stream 7 can also be generated by the powder from the powder container 16 being added to the high-pressure gas in variably changed quantities per unit time, preferably in pulsed fashion. This can be effected, for example, by in particular piezo-electric injectors 35 as influencing means.

It is also possible for the cold gas particle stream 7 to be modulated by pressure generators 29 as influencing means, preferably by piezo-electric pressure generators 29, which are arranged at the start of the Laval nozzle 8 or on the nozzle 8 and variably change the cross section of the Laval nozzle.

For example, the nozzle 8 may include a piezo-electric material or an internal piezo-electric coating, which expands or contracts as a result of the application of a voltage, thereby changing the cross section of the cold gas particle stream 7 and therefore also changing the particle density ρ, the pressure p and the velocity of the cold gas particle stream 7.

It is also possible for the cold gas particle stream 7 to be influenced in the region of the nozzle 8 by introduction of acoustic waves by means of a wave coupler 26, in particular an ultrasonic generator, which is positioned on the nozzle 8. These means in particular prevent particles from sticking in the nozzle 8.

It is also possible for the high-pressure gas to be controlled by a high-pressure valve 36 as influencing means. The high-pressure valve 36 is, for example, integrated in the high-pressure gas generator or present along a line 37 which feeds the gas from the high-pressure gas generator 22 to the powder.

The influencing means 25, 26, 29, 32, 35, 36 may be present and used individually, in pairs or in greater numbers.

Preferably, the material M is fed to the cold gas particle stream 7 in pulsed fashion by the powder injector(s) 35 and the velocity v of the cold gas particle stream 7 is modulated.

The mixing of the high-pressure gas originating from the high-pressure gas generator 22 and the powder arriving from the powder container 16 may take place upstream of the nozzle inlet opening 8' in a chamber 4 (FIG. 1, FIG. 2). It is also possible for the high-pressure gas stream and the particles only to be mixed with one another once they are inside the nozzle 8 (not shown).

Figure 7:
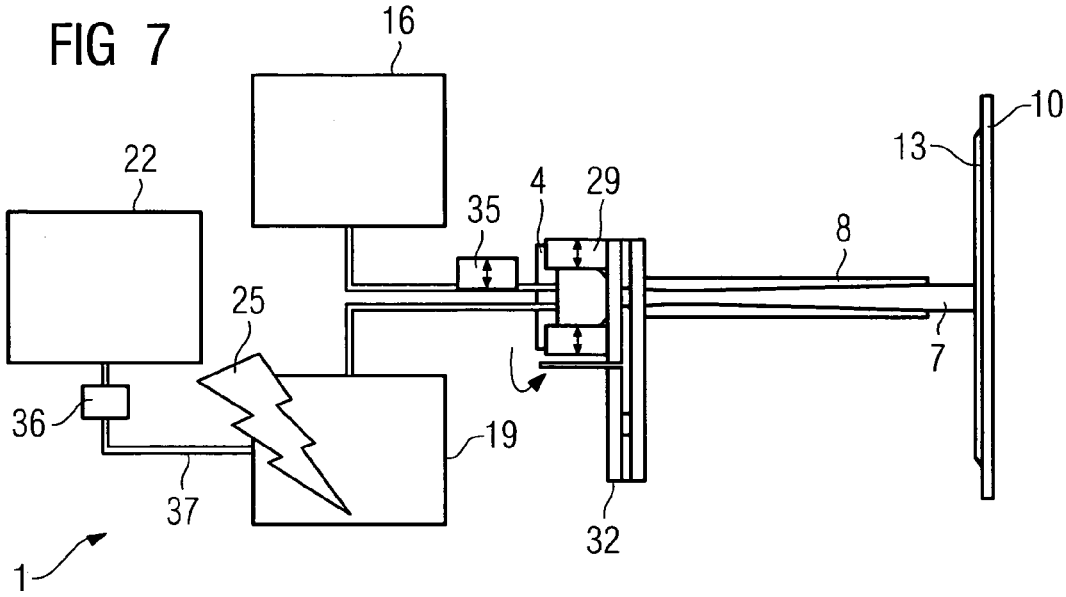
Figure 8:
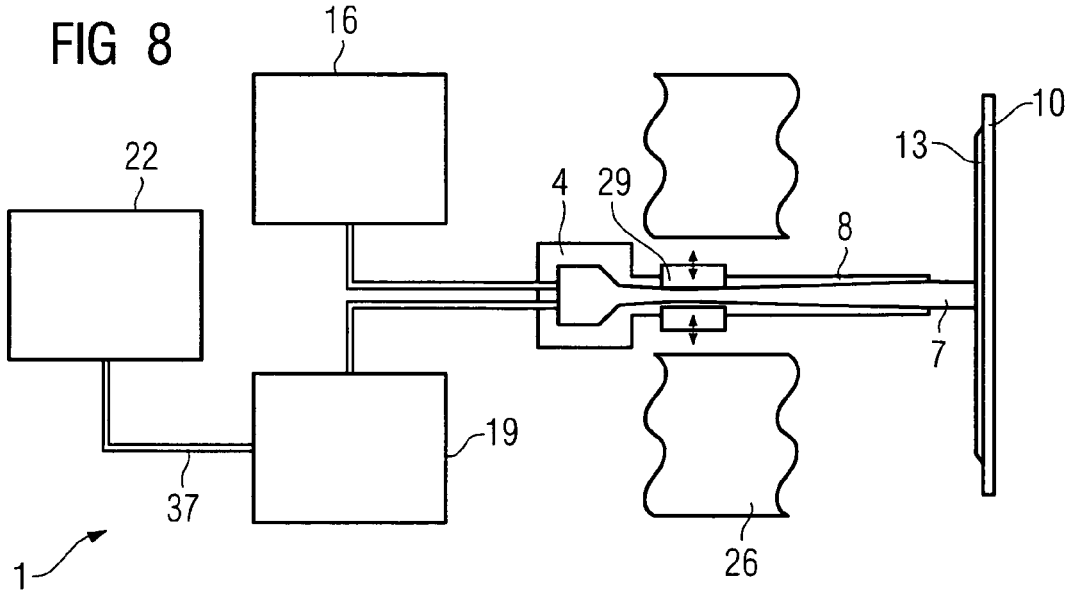

The influencing means 25, 32, 35, 36 may either be arranged only upstream of the nozzle inlet opening 8' (FIG. 7) or only downstream of the nozzle inlet opening 8' (FIG. 8).

In particular, the diameter F, the temperature T and/or the pressure p can be variably changed at the nozzle 8 in order to influence the cold gas particle stream 7.

It is also possible for the nozzle 8 to be heated in order to generate a constant temperature T of the cold gas particle stream 7 or for the temperature T of the cold gas particle stream 7 to be variably changed.

The entire cold spraying installation 1 may be arranged in a vacuum chamber (not shown).

Cold spraying means the use of temperatures of up to at most 80° C.-550° C., in particular 400° C. to 550° C. The substrate temperature is 80° C. to 100° C. The velocities are 300 m/s to 2000 m/s, in particular up to 900 m/s.

Figure 3:
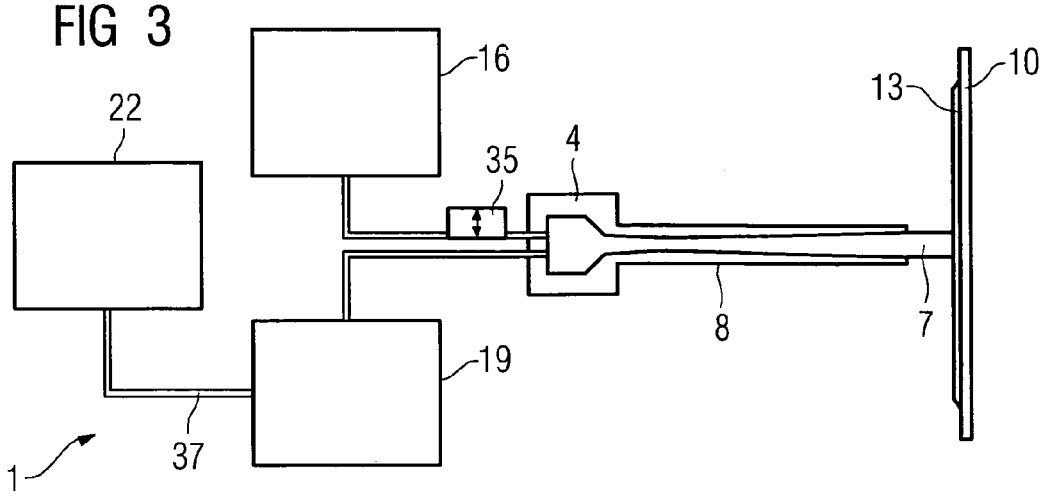

In FIG. 3 all that is present is a powder injector 35.

Figure 4:
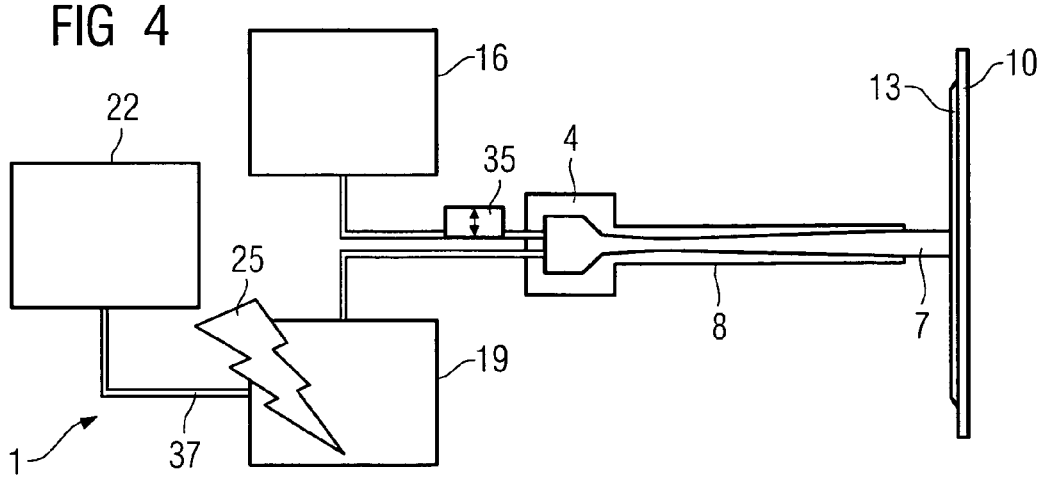

In FIG. 4 the powder injectors 35 and the pulsed heating means 25 are present and are used together or separately from one another.

Figure 5:
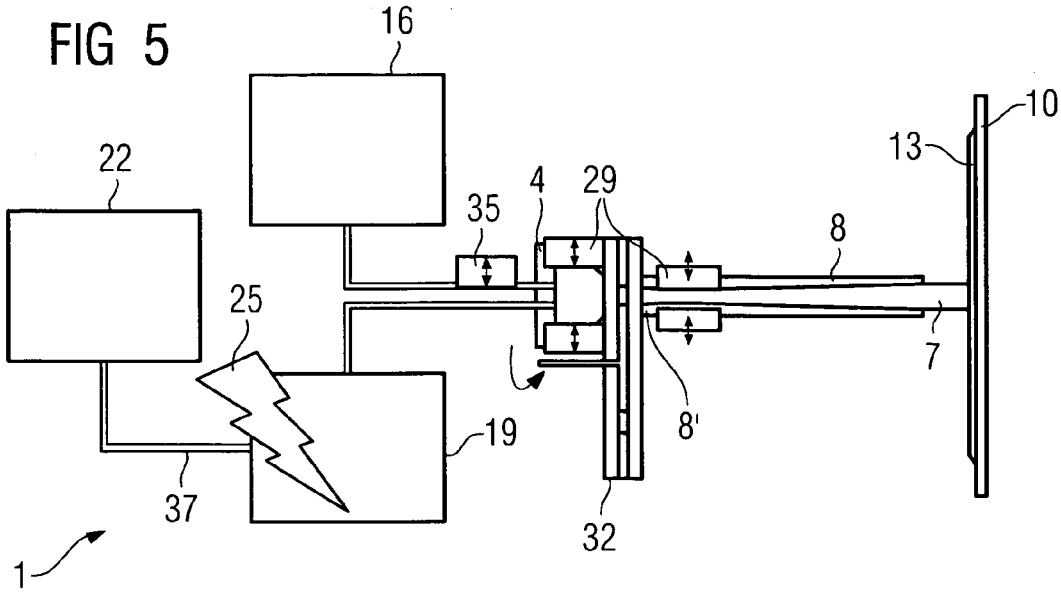

FIGS. 5, 7 and 8 also include, over and above FIG. 4, the pressure generators 29, which can be used individually, in pairs or together.

During a coating operation, the properties of the cold gas particle stream 7 can be changed individually or together, in particular if the change is in the same direction, i.e. an increase in temperature and an increase in pressure.

A temperature increase, pressure modulation or cross-sectional narrowing of the nozzle 8 of the cold gas particle stream 7 produces higher particle velocities and therefore better coating results.

Therefore, there are various conceivable ways of generating a pulsed cold gas particle stream 7:

- valve 32 upstream of the nozzle 8 or rotating perforated disk in the gas stream upstream of the nozzle 8,
- periodic narrowing of the cross section of the nozzle 8, preferably by means of piezo-electric ceramics or materials,
- pulsed gas heating,
- influencing the carrier gas velocity by introduction of acoustic waves.

The pulsed injection of powder particles can preferably be effected by means of a piezoelectric powder injector 35. In particular grain sizes of less than 1 μm, preferably less than 500 nm (nanoparticles) can be sprayed using the modulated cold gas particle streams 7.

It is also possible to use a plurality of powder injectors 35 with different powder materials M, in order to achieve graduated or multiple coatings.

There are no restrictions with regard to the choice of materials, which means that it is therefore possible to spray metals, metal alloys, semimetals and compounds thereof (carbides, nitrides, oxides, sulfides, phosphates, etc.) as well as semiconductors, high-temperature superconductors, magnetic materials, glasses and/or ceramics.

Figure 6:
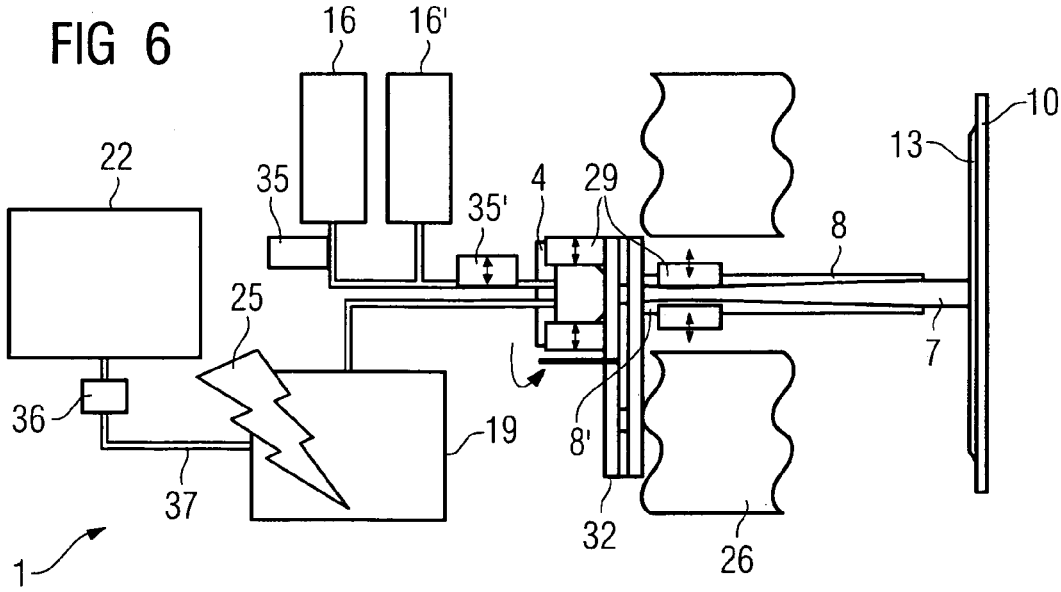

In FIG. 6 there are two powder containers 16, 16', which contain different materials for the particles. The materials of the powder containers 16, 16' can be added simultaneously, or alternatively it is possible for just one powder container 16, 16' to be active.

In particular if the particles have different particle sizes, it is expedient to change the velocity v of the cold gas particle stream, so that for example the same momentum is achieved for smaller, i.e. lighter, particles. In this case, it is also possible to use two gas heaters and/or two high-pressure gas generators.

Figure 9:
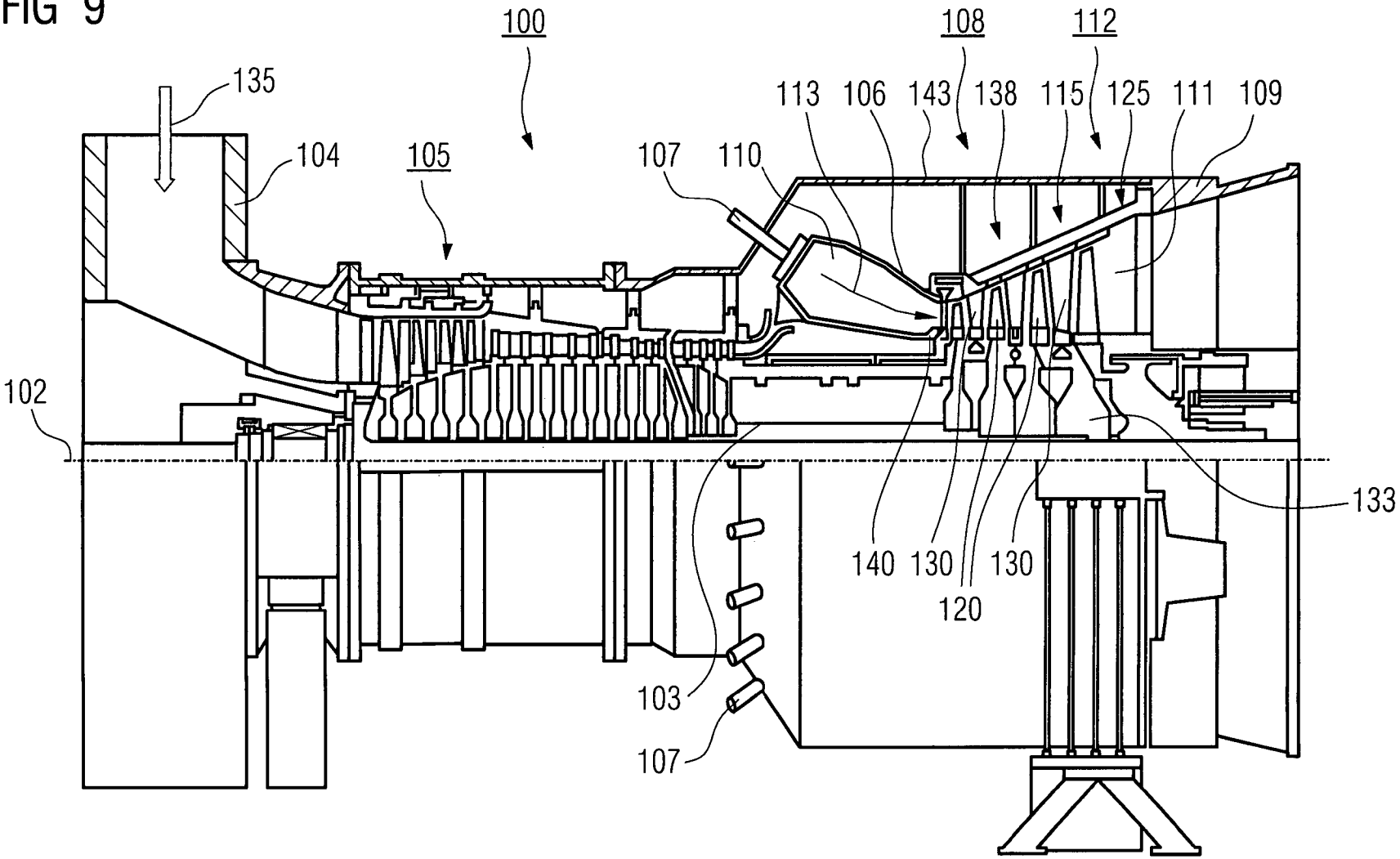
FIG. 9 shows a gas turbine.

FIG. 9 shows, by way of example, a partial longitudinal section through a gas turbine 100. In the interior, the gas turbine 100 has a rotor 103 with a shaft 101 which is mounted such that it can rotate about an axis of rotation 102 and is also referred to as the turbine rotor.

An intake housing 104, a compressor 105, a, for example, toroidal combustion chamber 110, in particular an annular combustion chamber, with a plurality of coaxially arranged burners 107, a turbine 108 and the exhaust-gas housing 109 follow one another along the rotor 103.

The annular combustion chamber 106 is in communication with a, for example, annular hot-gas passage 111, where, by way of example, four successive turbine stages 112 form the turbine 108.

Each turbine stage 112 is formed, for example, from two blade or vane rings. As seen in the direction of flow of a working medium 113, in the hot-gas passage 111 a row of guide vanes 115 is followed by a row 125 formed from rotor blades 120.

The guide vanes 130 are secured to an inner housing 138 of a stator 143, whereas the rotor blades 120 of a row 125 are fitted to the rotor 103 for example by means of a turbine disk 133.

A generator (not shown) is coupled to the rotor 103.

While the gas turbine 100 is operating, the compressor 105 sucks in air 135 through the intake housing 104 and compresses it. The compressed air provided at the turbine-side end of the compressor 105 is passed to the burners 107, where it is mixed with a fuel. The mix is then burnt in the combustion chamber 110, forming the working medium 113. From there, the working medium 113 flows along the hot-gas passage 111 past the guide vanes 130 and the rotor blades 120. The working medium 113 is expanded at the rotor blades 120, transferring its momentum, so that the rotor blades 120 drive the rotor 103 and the latter in turn drives the generator coupled to it.

While the gas turbine 100 is operating, the components which are exposed to the hot working medium 113 are subject to thermal stresses. The guide vanes 130 and rotor blades 120 of the first turbine stage 112, as seen in the direction of flow of the working medium 113, together with the heat shield elements which line the annular combustion chamber 110, are subject to the highest thermal stresses.

To be able to withstand the temperatures which prevail there, they have to be cooled by means of a coolant.

Substrates of the components may likewise have a directional structure, i.e. they are in single-crystal form (SX structure) or have only longitudinally oriented grains (DS structure).

By way of example, iron-base, nickel-base or cobalt-base superalloys are used as material for the components, in particular for the turbine blade or vane 120, 130 and components of the combustion chamber 110. Superalloys of this type are known, for example, from EP 1 204 776 B1, EP 1 306 454, EP 1 319 729 A1, WO 99/67435 or WO 00/44949; these documents form part of the disclosure with regard to the chemical composition of the alloys.

The guide vane 130 has a guide vane root (not shown here) facing the inner housing 138 of the turbine 108 and a guide vane head at the opposite end from the guide vane root. The guide vane head faces the rotor 103 and is fixed to a securing ring 140 of the stator 143.

Figure 10:
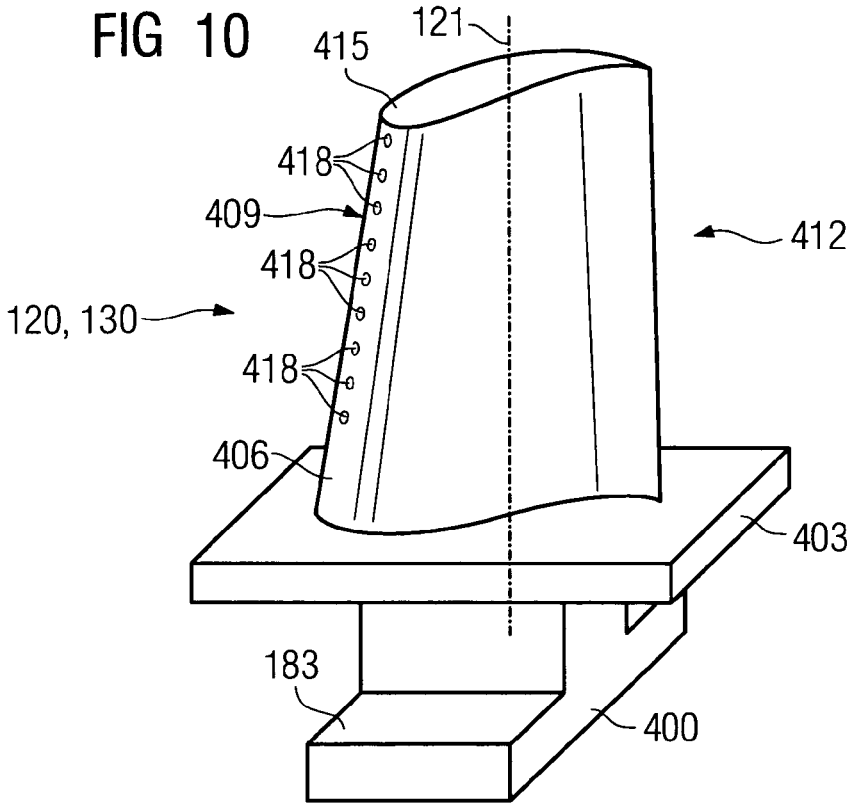
FIG. 10 shows a perspective view of a turbine blade or vane.

FIG. 10 shows a perspective view of a rotor blade 120 or guide vane 130 of a turbomachine, which extends along a longitudinal axis 121.

The turbomachine may be a gas turbine of an aircraft or of a power plant for generating electricity, a steam turbine or a compressor.

The blade or vane 120, 130 has, in succession along the longitudinal axis 121, a securing region 400, an adjoining blade or vane platform 403, a main blade or vane part 406, and a blade or vane tip. As a guide vane 130, the vane 130 may have a further platform (not shown) at its vane tip 415.

A blade or vane root 183, which is used to secure the rotor blades 120, 130 to a shaft or a disk (not shown), is formed in the securing region 400. The blade or vane root 183 is designed, for example, in hammerhead form. Other configurations, such as a fir-tree or dovetail root, are possible. The blade or vane 120, 130 has a leading edge 409 and a trailing edge 412 for a medium which flows past the main blade or vane part 406.

In the case of conventional blades or vanes 120, 130, by way of example, solid metallic materials, in particular superalloys, are used in all regions 400, 403, 406 of the blade or vane 120, 130.

Superalloys of this type are known, for example, from EP 1 204 776 B1, EP 1 306 454, EP 1 319 729 A1, WO 99/67435 or WO 00/44949; these documents form part of the disclosure with regard to the chemical composition of the alloy.

The blade or vane 120, 130 may in this case be produced by a casting process, also by means of directional solidification, by a forging process, by a milling process or combinations thereof.

Workpieces with a single-crystal structure or structures are used as components for machines which, in operation, are exposed to high mechanical, thermal and/or chemical stresses.

Single-crystal workpieces of this type are produced, for example, by directional solidification from the melt. This involves casting processes in which the liquid metallic alloy solidifies to form the single-crystal structure, i.e. the single-crystal workpiece, or solidifies directionally.

In this case, dendritic crystals are oriented along the direction of heat flow and form either a columnar crystalline grain structure (i.e. grains which run over the entire length of the workpiece and are referred to here, in accordance with the language customarily used, as directionally solidified) or a single-crystal structure, i.e. the entire workpiece consists of one single crystal. In these processes, a transition to globular (polycrystalline) solidification needs to be avoided, since non-directional growth inevitably forms transverse and longitudinal grain boundaries, which negate the favorable properties of the directionally solidified or single-crystal component.

Where the text refers in general terms to directionally solidified microstructures, this is to be understood as meaning both single crystals, which do not have any grain boundaries or at most have small-angle grain boundaries, and columnar crystal structures, which do have grain boundaries running in the longitudinal direction but do not have any transverse grain boundaries. This second form of crystalline structures is also described as directionally solidified microstructures (directionally solidified structures).

Processes of this type are known from U.S. Pat. No. 6,024,792 and EP 0 892 090 A1; these documents form part of the disclosure with regard to the solidification process.

The blades or vanes 120, 130 may likewise have coatings protecting against corrosion or oxidation (MCrAlX; M is at least one element selected from the group consisting of iron (Fe), cobalt (Co), nickel (Ni), X is an active element and represents yttrium (Y) and/or silicon and/or at least one rare earth element, or hafnium (Hf)). Alloys of this type are known from EP 0 486 489 B1, EP 0 786 017 B1, EP 0 412 397 B1 or EP 1 306 454 A1, which are intended to form part of the present disclosure with regard to the chemical composition of the alloy.

The density is preferably 95% of the theoretical density. A protective aluminum oxide layer (TGO=thermally grown oxide layer) is formed on the MCrAlX layer (as interlayer or as outermost layer).

It is also possible for a thermal barrier coating, which is preferably the outermost layer and consists, for example, of $ZrO_2$, $Y_2O_3$—$ZrO_2$, i.e. unstabilized, partially stabilized or fully stabilized by yttrium oxide and/or calcium oxide and/or magnesium oxide, to be present on the MCrAlX.

The thermal barrier coating covers the entire MCrAlX layer. Columnar grains are produced in the thermal barrier coating by means of suitable coating processes, such as for example electron beam physical vapor deposition (EB-PVD).

Other coating processes are conceivable, for example atmospheric plasma spraying (APS), LPPS, VPS or CVD. The thermal barrier coating may include grains which are porous, have microcracks or have macrocracks, in order to improve the resistance to thermal shocks. Therefore, the thermal barrier coating is preferably more porous than the MCrAlX layer.

The blade or vane 120, 130 may be hollow or solid in form. If the blade or vane 120, 130 is to be cooled, it is hollow and may also have film-cooling holes 418 (indicated by dashed lines).

Figure 11:
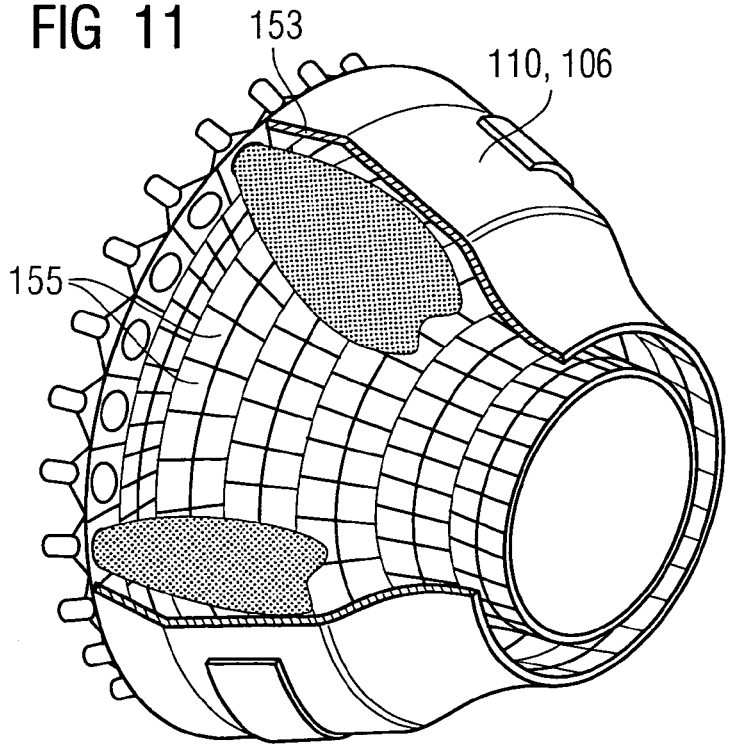
FIG. 11 shows a combustion chamber.

FIG. 11 shows a combustion chamber 110 of a gas turbine 100. The combustion chamber 110 is configured, for example, as what is known as an annular combustion chamber, in which a multiplicity of burners 107 which generate flames 156 and are arranged circumferentially around the axis of rotation 102 open out into a common combustion chamber space 154. For this purpose, the combustion chamber 110 overall is of annular configuration positioned around the axis of rotation 102.

To achieve a relatively high efficiency, the combustion chamber 110 is designed for a relatively high temperature of the working medium M of approximately 1000° C. to 1600° C. To allow a relatively long service life even with these operating parameters, which are unfavorable for the materials, the combustion chamber wall 153 is provided, on its side which faces the working medium M, with an inner lining formed from heat shield elements 155.

On account of the high temperatures in the interior of the combustion chamber 110, it is also possible for a cooling system to be provided for the heat shield elements 155 and/or for their holding elements. The heat shield elements 155 are then, for example, hollow and may also include cooling holes (not shown) which open out into the combustion chamber space 154.

On the working medium side, each heat shield element 155 is equipped with a particularly heat-resistant protective layer (MCrAlX layer and/or ceramic coating) or is made from material that is able to withstand high temperatures (solid ceramic bricks).

These protective layers may be similar to the turbine blades or vanes, i.e. by way of example MCrAlX, in which M is at least one element selected from the group consisting of iron (Fe), cobalt (Co), nickel (Ni), X is an active element and stands for yttrium (Y) and/or silicon and/or at least one rate earth element or hafnium (Hf). Such alloys are known from EP 0 486 489 B1, EP 0 786 017 B1, EP 0 412 397 B1 or EP 1 306 454 A1, which are intended to form part of the present disclosure with regard to the chemical composition of the alloy.

It is also possible for a, for example ceramic, thermal barrier coating, consisting for example of $ZrO_2$, $Y_2O_3$—$ZrO_2$, i.e. unstabilized, partially stabilized or fully stabilized by yttrium oxide and/or calcium oxide and/or magnesium oxide, to be present on the MCrAlX.

Columnar grains are produced in the thermal barrier coating by means of suitable coating processes, such as for example electron beam physical vapor deposition (EB-PVD). Other coating processes are conceivable, e.g. atmospheric plasma spraying (APS), LPPS, VPS or CVD. The thermal barrier coating may have grains which are porous, have microcracks or have macrocracks, in order to improve the resistance to thermal shocks.

Refurbishment means that after they have been used, protective layers may have to be removed from turbine blades or vanes 120, 130, heat shield elements 155 (e.g. by sand-blasting). Then, the corrosion and/or oxidation layers and products are removed. If appropriate, cracks in the turbine blade or vane 120, 130 or the heat shield element 155 are also repaired. This is followed by recoating of the turbine blades or vanes 120, 130, heat shield elements 155, after which the turbine blades or vanes 120, 130 or the heat shield element 155 are reused.

LIST OF DESIGNATIONS

1 Cold spraying apparatus
4 Mixing burner
7 Cold gas particle stream
8 Nozzle/Laval nozzle
10 Substrate
13 Coating
16 Powder container
19 Heater
22 High-pressure gas generator
25 Pulsed heating means/influencing means
26 Acoustic coupler/influencing means
29 Piezoelectric pressure generator/influencing means
32 Valve/disk/influencing means
35 Powder injector/influencing means
100 Gas turbine
101 Shaft
102 Axis of rotation
103 Rotor
104 Intake housing
105 Compressor
106 Annular combustion chamber
107 Burner
108 Turbine
109 Exhaust-gas housing
110 Combustion chamber
111 Hot-gas passage
112 Turbine stage
113 Working medium
115 Row of guide vanes
120 Rotor blade
121 longitudinal axis
125 Row
130 Guide vane
133 Turbine disk
135 Air
138 Inner housing
140 Securing ring
143 Stator
153 Combustion chamber wall
154 Combustion chamber space
155 Heat shield element
156 Flames
183 Blade or vane root
400 Securing region
403 Blade or vane platform
406 Main blade or vane part
409 Leading edge
412 Trailing edge
415 Blade or vane tip
418 Film cooling holes

The invention claimed is:

1. A cold spraying installation, comprising:

a powder container;

a high-pressure gas generator that generates a high-pressure gas;

a gas heater;

a nozzle that emits a cold gas particle stream, and a plurality of influencing devices that result in a variable change in a property of the cold gas particle stream selected from the group consisting of: temperature, pressure, particle density, particle material, and velocity, wherein the influencing devices periodically or aperiodically adjust the property of the cold gas particle stream, and wherein the influencing devices are:

a powder injector where the powder from the powder container is provided to the high-pressure gas in a pulsed manner where the particle density of the cold gas particle stream can be varied, a pulsed heating device where a high-pressure gas can be variably heated resulting in adjustment of the temperature of the cold gas particle stream, a rotating perforated disk valve arranged upstream of a nozzle inlet opening to adjust the particle density of the cold gas particle stream, a piezo-electric pressure generator that adjusts a cross section of the nozzle, an ultrasonic acoustic wave generator that compresses or expands the cold gas particle stream, or a high-pressure valve in the high-pressure gas generator or in a line of the high-pressure gas generator that variably interrupts the flow of the high-pressure gas out of the high-pressure gas generator to adjust the pressure in the cold gas particle stream.

2. The cold spraying installation as claimed in claim 1, wherein the cold spraying installation is arranged inside a vacuum chamber.

3. The cold spraying installation as claimed in claim 2, wherein the high-pressure gas and the powder is mixed upstream of the nozzle or in the nozzle.

4. The cold spraying installation as claimed in claim 3, further comprising two powder containers and two powder injectors.

5. A cold spraying installation, comprising:

a powder container;

a high-pressure gas generator that generates a high-pressure gas;

a gas heater;

a nozzle that emits a cold gas particle stream, and a plurality of influencing devices that result in a variable change in a property of the cold gas particle stream selected from the group consisting of: temperature, pressure, particle density, particle material, and velocity, wherein the influencing devices periodically or aperiodicaliy adjust the property of the cold gas particle stream, and wherein the influencing devices are:

a powder injector where a powder from the powder container is provided to the high-pressure gas in a pulsed manner where the particle density of the cold gas particle stream can be varied, a pulsed heating device where the high-pressure gas can be variably heated resulting in adjustment of the temperature of the cold gas particle stream, a rotating perforated disk valve arranged upstream of the nozzle inlet opening to adjust the particle density of the cold gas particle stream, a piezo-electric pressure generator that adjusts a cross section of the nozzle, an ultrasonic acoustic wave generator that compresses or expands the cold gas particle stream, and a high-pressure valve in the high-pressure gas generator or at a line of the high-pressure gas generator can variably interrupt the flow of the high-pressure gas out of the high-pressure gas generator to adjust the pressure in the cold gas particle stream.

* * * * *